US008127974B2

(12) United States Patent
Zhang et al.

(10) Patent No.: US 8,127,974 B2
(45) Date of Patent: Mar. 6, 2012

(54) ELECTRICAL MOTOR DRIVEN NAIL GUN

(76) Inventors: Huading Zhang, Taizhou (CN); Qinyao Zhang, Taizhou (CN)

( * ) Notice: Subject to any disclaimer, the term of this patent is extended or adjusted under 35 U.S.C. 154(b) by 277 days.

(21) Appl. No.: 12/392,107

(22) Filed: Feb. 25, 2009

(65) Prior Publication Data

US 2010/0213236 A1 Aug. 26, 2010

(51) Int. Cl.
*B25C 1/06* (2006.01)

(52) U.S. Cl. ..... 227/133; 227/131; 227/129; 173/124; 173/205; 173/217; 173/117

(58) Field of Classification Search ..... 227/133, 227/131, 129; 173/124, 205, 217, 117
See application file for complete search history.

(56) References Cited

U.S. PATENT DOCUMENTS 6,705,503 B1 * 3/2004 Pedicini et al. ..... 227/131
6,769,593 B2 * 8/2004 Pedicini et al. ..... 227/131
6,971,567 B1 * 12/2005 Cannaliato et al. ..... 227/2
2004/0232194 A1 * 11/2004 Pedicini et al. ..... 227/131
2006/0091176 A1 * 5/2006 Cannaliato et al. ..... 227/8
2006/0091177 A1 * 5/2006 Cannaliato et al. ..... 227/8

* cited by examiner

*Primary Examiner* — Rinaldi I. Rada
*Assistant Examiner* — Michelle Lopez
(74) *Attorney, Agent, or Firm* — Pro-Techtor Int'l Services; Ralph Willgohs

(57) ABSTRACT

The new invention is a portable tool, specifically directed electric motor driven nail gun. It has a nail push system, also a motor. The motor uses a flywheel as a speed reduction mechanism, the main characteristic is that the drive unit of the driving mechanism is connected to a pitman by a pin axis on one end, and the other end is connected to the pin axis which does the arc movement. The end of the drive unit props up the long slot by a spring and enclosed by the long slot in a sliding movement. The rectilinear reciprocating drive unit is governed by a clutching mechanism mounted on the speed reduction mechanism. The new invention can provide a powerful impacting force. The clutch bar of the driving mechanism has an outer bulge and inner bulge, it controls the tension spring which makes the drive unit impact nails and recover after impacting nails, without any memory of the rotating state.

8 Claims, 9 Drawing Sheets

ELECTRICAL MOTOR DRIVEN NAIL GUN

This new invention relates to a handheld power tool, specifically to an electrical motor driven nail gun which impacts a nail or staple into a workpiece.

BACKGROUND OF INVENTION

The most common fastening systems of conventional electrical motor driven nail guns are described below:

The first design uses solenoid driven mechanisms. One of the drawbacks of these types of mechanisms is that the force provided by a solenoid is governed by the number of ampere-turns in the solenoid. In order to obtain the high forces required for driving nails and staples into the work piece, a large number of turns are required in addition to high current pulses. These requirements are counterproductive as the resistance of the coil increases in direct proportion to the length of the wire in the solenoid windings. This design limits most solenoid driven mechanisms to short stroke small load applications.

A second design is based on a multiple impact design. In this design, a motor or other power source is connected to the impact anvil through either a lost motion coupling or other. This allows the power source to make multiple impacts on the nail thus driving it into the working piece. The disadvantages in this design that include increased operator fatigue since the actuation technique is a series of blows rather than a continuous drive motion.

A third design which is taught includes the use of spring as energy storage mechanisms. In these designs, once the spring is sufficiently compressed, the energy is released from the spring into the anvil (or nail driving piece) thus pushing the nail into the substrate. Several drawbacks exist to this design. These include the need for a complex system of compressing and controlling the spring and the fact that the force delivery characteristics of a spring are not well suited for driving nails. As the nail is driven into the wood, more force is needed as the stroke increases. This is inherently backwards to a spring's unloading scheme in which it delivers less force as it returns to its zero energy state.

A fourth design that is taught includes the using a flywheel to store energy to drive a fastener; this design is detailed in British Patent #2,000,716. This patent teaches me use of a continuously rotating mechanism. The disadvantages in this design include increased operator fatigue by the noisy, continuously rotating mechanism. Also, this uses a friction clutch mechanism that is complicated, heavy and subject to wear.

A fifth design uses flywheels as energy storage means. The flywheels are used to launch a hammering anvil that impacts the nail. This design is detailed in U.S. Pat. No. 6,604,666B1. The major drawback to this design is that the flywheels and the clutch mechanisms are asynchronous. The complete mechanism is complicated and a memory of rotating position. It shows that all energy is stored in the flywheel when the rotation angle is within 150 degree. If the operator launches the trigger when the rotation angle is less than 100 degree or if caused by an obstacle, so that the driving of the anvil that impacts the nail is not completed, when the trigger is launched again, the fly wheel will only rotate a 50 degree angle, so that the power which is stored in the fly wheel is not strong enough to drive the nail into the work piece. So it requires design of a complicated circuit to control additional rotating mechanisms (counter rotating), which allow the motor to counter-rotate the 100 degrees to reach the 0 degree (initially location).

A sixth design, U.S. Pat. No. 6,705,503B1, shows that a longer guide rail is very important to prevent the moving pin jamming the solenoid and cam system. A drawback to this design is not self-resetting. Once the operator launches the trigger, if the mechanism is stopped in the middle location of the guide rail, and then the trigger is launched again, the power source of the action from the middle location to the end is not strong enough to effect a normal driving of the anvil that impacts the nail. So it needs an additional rotation mechanism (counter rotating) to get the motor back to initial location, and its additional action causes unwanted time for operator.

All the currently available devices suffer from a number of disadvantages that include:

1. Solenoid driven mechanisms limit large current, and don't provide a good effect of driving (impact on the nail).
2. Multiple impact design causes increased operator fatigue.
3. Mechanisms in the form of spring do not wear well since the spring doesn't have a predictable rated lifetime.
4. It's hard to hold the tool still when a flywheel mechanism is continuously rotating, and wastes unnecessary user energy.
5. Flywheels and cam hold asynchronous clutch mechanisms are complicated and require memory of rotational position. It needs a complicated circuit to control the additional rotating mechanism (counter rotating). This counter-rotating action is unnecessary to the principal task.
6. A longer guide rail holds up the pin and also needs a memory of the rotating state. It also needs a complicated circuit to control the additional rotating mechanism (counter rotating). The action is unwanted and not easy to operate.

SUMMARY OF THE INVENTION

This new invention can achieve the driving purpose (impacting the nail) and prevent the disadvantages as above, thereby providing a relative simple operating, steady solution for an electrical motor driven nail gun.

The purpose of the new invention can achieve by those technique means as below for an electrical motor driven nail gun. It comprises a bracket, switch, control unit, magazine and nail feed system, also a motor which drives its power from a power supply or rechargeable batteries. The motor drives the flywheel as a speed reduction mechanism, one main characteristic is that the anvil of the driving mechanism is connected to a pitman by a pin axis on one end, and connected on the other end to the pin axis of the driving block which does an arc movement. One end of the drive unit is connected with the tension spring and long board to the long slot in which they have a sliding movement. The clutching mechanism of the speed reduction mechanism controls the circular motion of the driving block to produce linear movement in the drive unit.

The above speed reduction mechanism includes a pinion and flywheel which engage each other, the pinion is driven by the motor against a rack formed on the flywheel in one embodiment the rack is formed on an interior peripheral surface of the flywheel.

The clutching mechanism comprises a solenoid, cam, and clutch bar and clutch spring, the cam is driven by a solenoid, and the solenoid is controlled by control unit. The clutch bar and spring is assembled in a radial slot on the flywheel, the driving block is settled on the arcuate slot on the slot board, the solenoid drives the cam to move down, and the bulge of the cam pushes the clutch bar toward the centre of the flywheel against the power of the clutch spring.

The above clutch bar has an outer bulge and an inner bulge, the space between them forms a gate, the gate shifts when the clutch block is pushed by the cam. The outer bulge pushes the driving block, the driving block and the pitman start to rotate pushed by the clutch bar which is driven by the high speed rotating flywheel.

The above high speed rotating flywheel, pushing the driving block by the clutch bar, generates a rotating power due to the law of inertia that is far stronger than the elastic force of the clutch spring and the centrifugal force, so that when the clutch bar leaves the cam, it will not be repositioned by the clutch spring and it able to keep pushing the driving block which will rotate together with the pitman to complete the driving operation.

When the above high speed rotating flywheel is pushing the driving block by clutch bar after leaving the cam, if flywheel stops suddenly or by other trouble, the clutch bar loses the rotating power due to the law of inertia, the clutch spring pushes clutch bar outward on the circle (opposite of the centre of circle) releasing the mechanism. An important point of this invention is: when the clutch bar is pushed outward by the disengage block, the system returns to an initial state, without requiring any memory of the rotating state.

The above flywheel is positioned between the bracket and the slot board, the spring setting in the centre of the slot board, and one end of the spring is connected to the driving block. The cross-section of the driving block has an "I" shape. The upside of the driving block engages one end of the pitman, on the underside is an outer bulge of the driving block, and the middle is positioned in the arcuate slot. There are also some holes for mounting the disengage block. When the flywheel is rotating the clutch bar is pushed outwards on the flywheel. The returning power of the a tension spring and a twisting spring makes the anvil and the driving block return to the initial location quickly after completing the driving operation. The flywheel can then idle with the driving block passing through the gate of the clutch bar.

The power source of the motor or rechargeable batteries are connected to a main switch and a safety switch in series, the main switch connected in series between control unit and motor, and the safety switch is connected to the control unit. When the driving operation is complete, the drive unit driving trigger, which completes the main switch, turns off.

The results of this invention are: the transmission of the power using a speed reduction mechanism which is engaged by pinion and a flywheel, a large electric current is not needed, so the power and volume of the machine can be much slimmer.

The driving mechanism includes a clutching mechanism which has an outer bulge and an inner bulge, controls the anvil impacting on a nail and is returned by a tension spring, no memory function is required; the device is easy and steady for operating.

The main switch only works when the safety switch is on. This means safety, steadiness and practicality.

Objectives of the present invention include:

1. To provide a electrical motor driven nail gun in which no large electric current is needed, so that a small power motor can be used in order to reduce the volume and weight.
2. To provide a electrical motor driven nail gun in which the gun uses a cam activated clutch block, and the clutch block drives the driving bar, for reducing wear.
3. To provide a electrical motor driven nail gun in which the circuit design is simpler, with no need for a complicated additional rotation system (counter rotating).
4. To provide an electrical motor driven nail gun in which the outer gear is driven from a pinion driven by the motor, and the rack is formed inside of the flywheel, allowing a small size.
5. To provide a electrical motor driven nail gun in which if the flywheel is stopped in case of any trouble condition, the clutch bar drive will release and the system return to an initial state, without requiring any memory.

We know that a great invention lies in using an easy way to overcome complicated circuit design and mechanical construction.

Further objects and advantages will become more apparent from a consideration of the ensuing description and drawings.

DETAILED DESCRIPTION OF THE INVENTION

The operation of the invention has significant improvements over that which has been described in the art.

Figure 1:
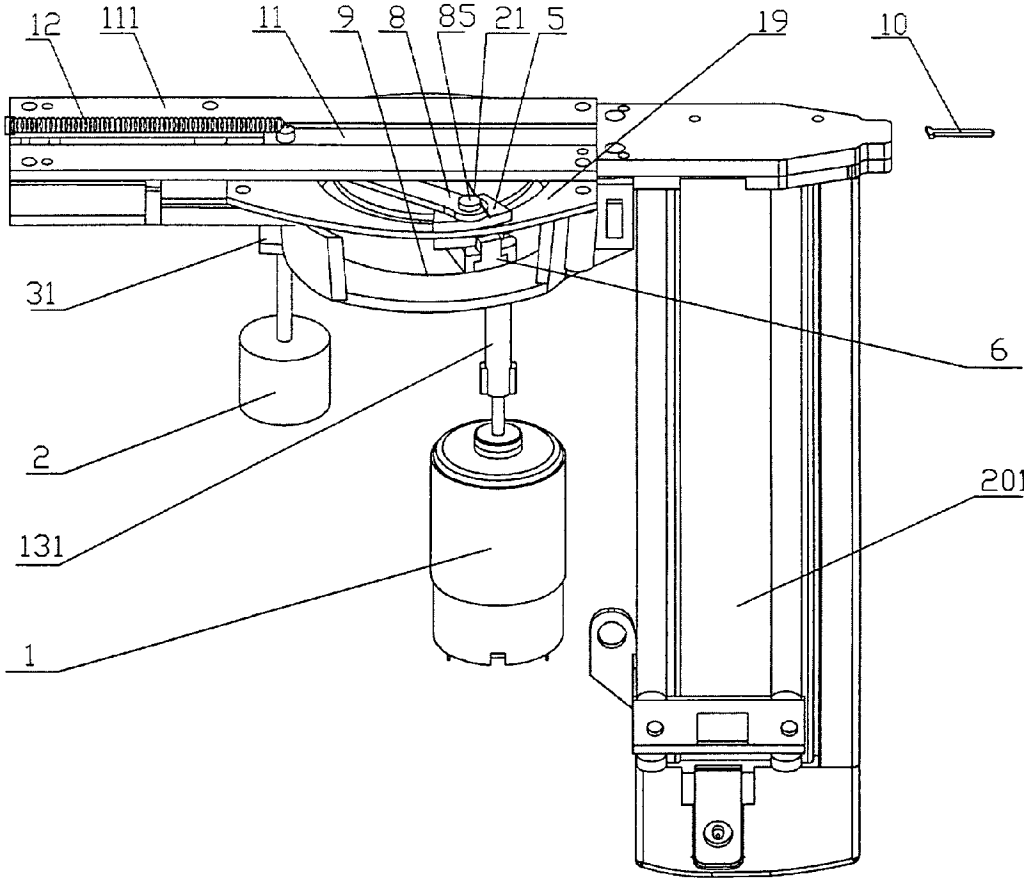
FIG. 1 is an overview of the fastener-driving tool embodying the invention.
Figure 2:
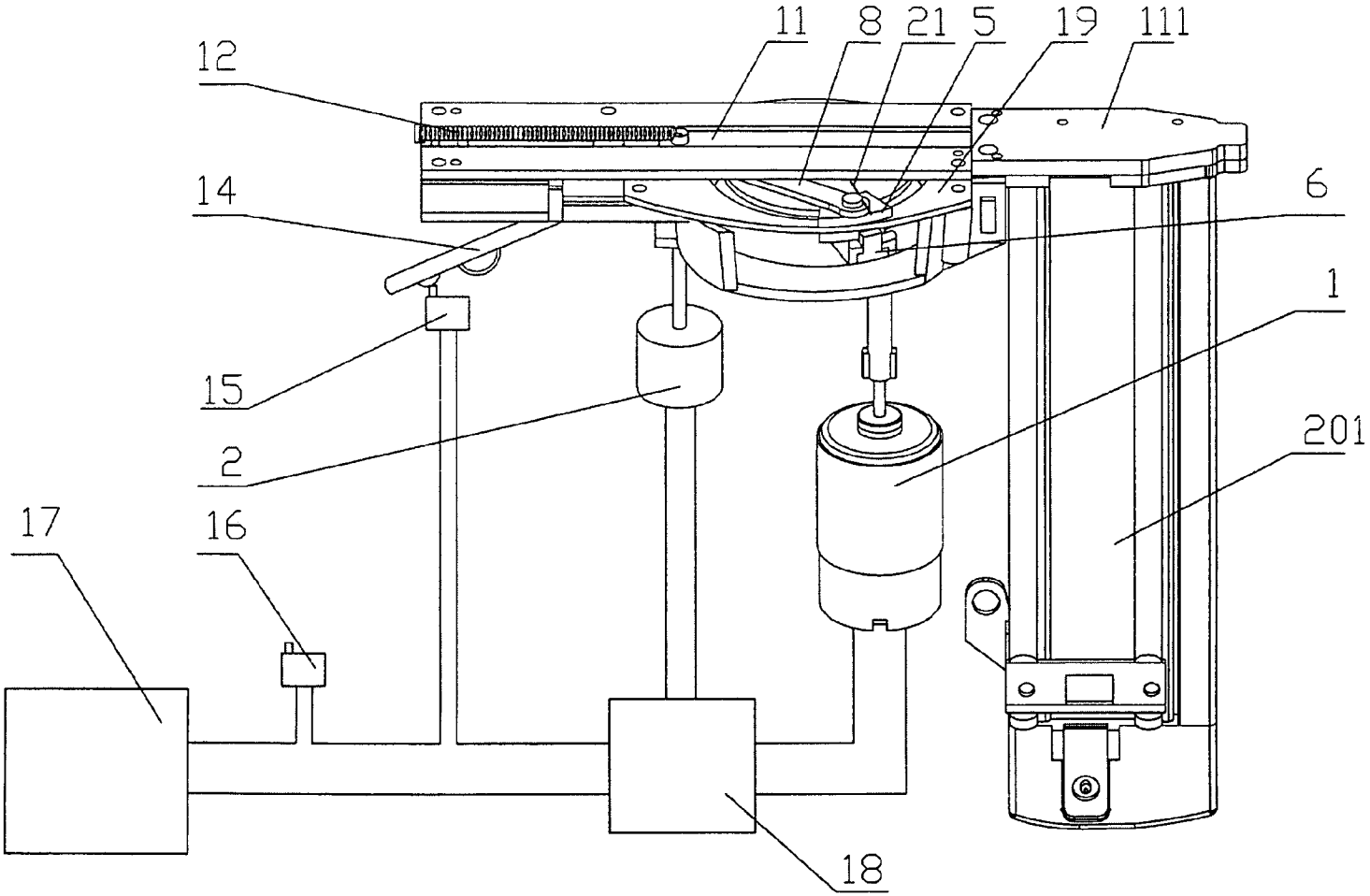
FIG. 2 is a schematic of the elements of a circuit for the electrical driving nail gun.
Figure 4:
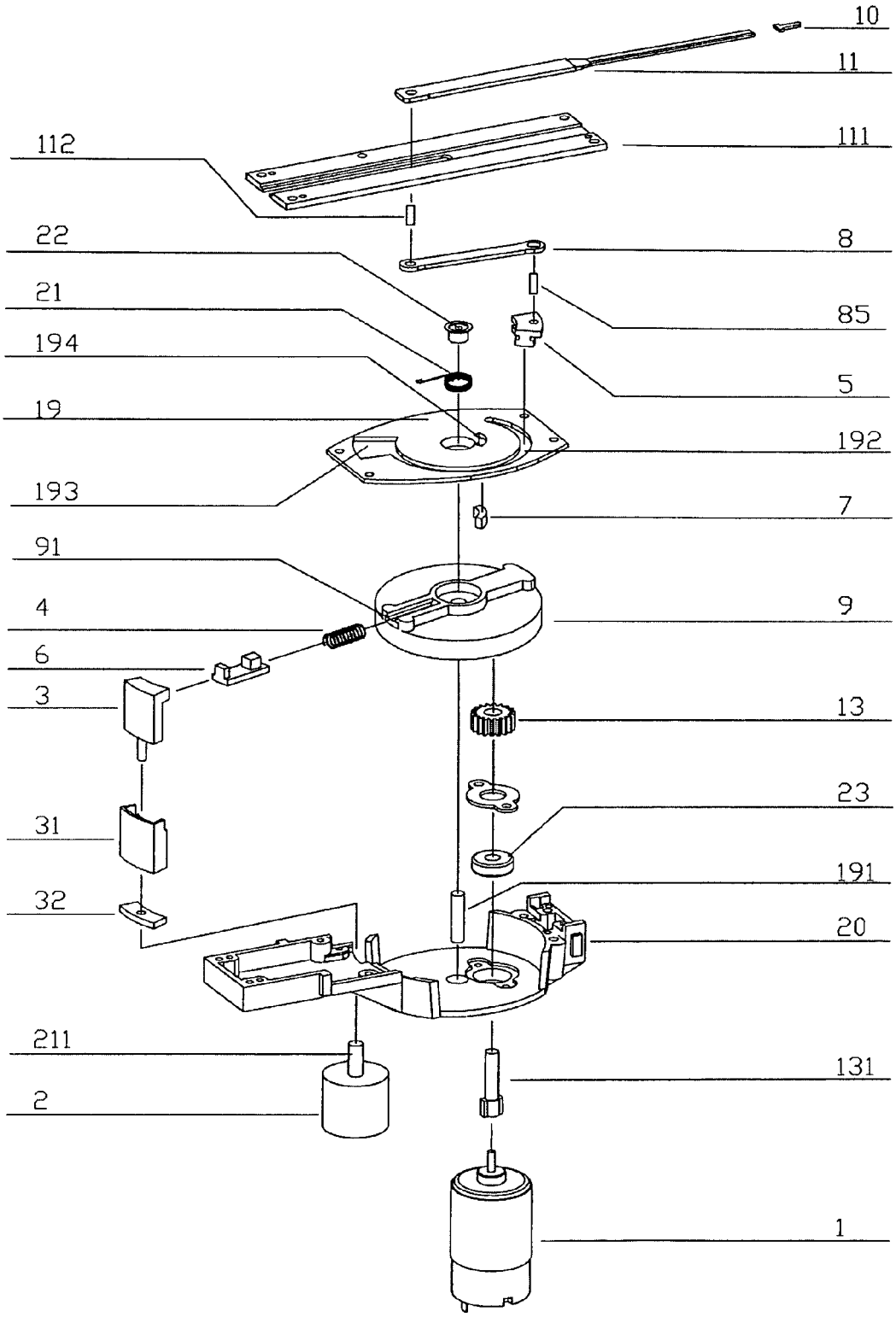
FIG. 4 is the assembling instruction of this new invention.
Figure 5:
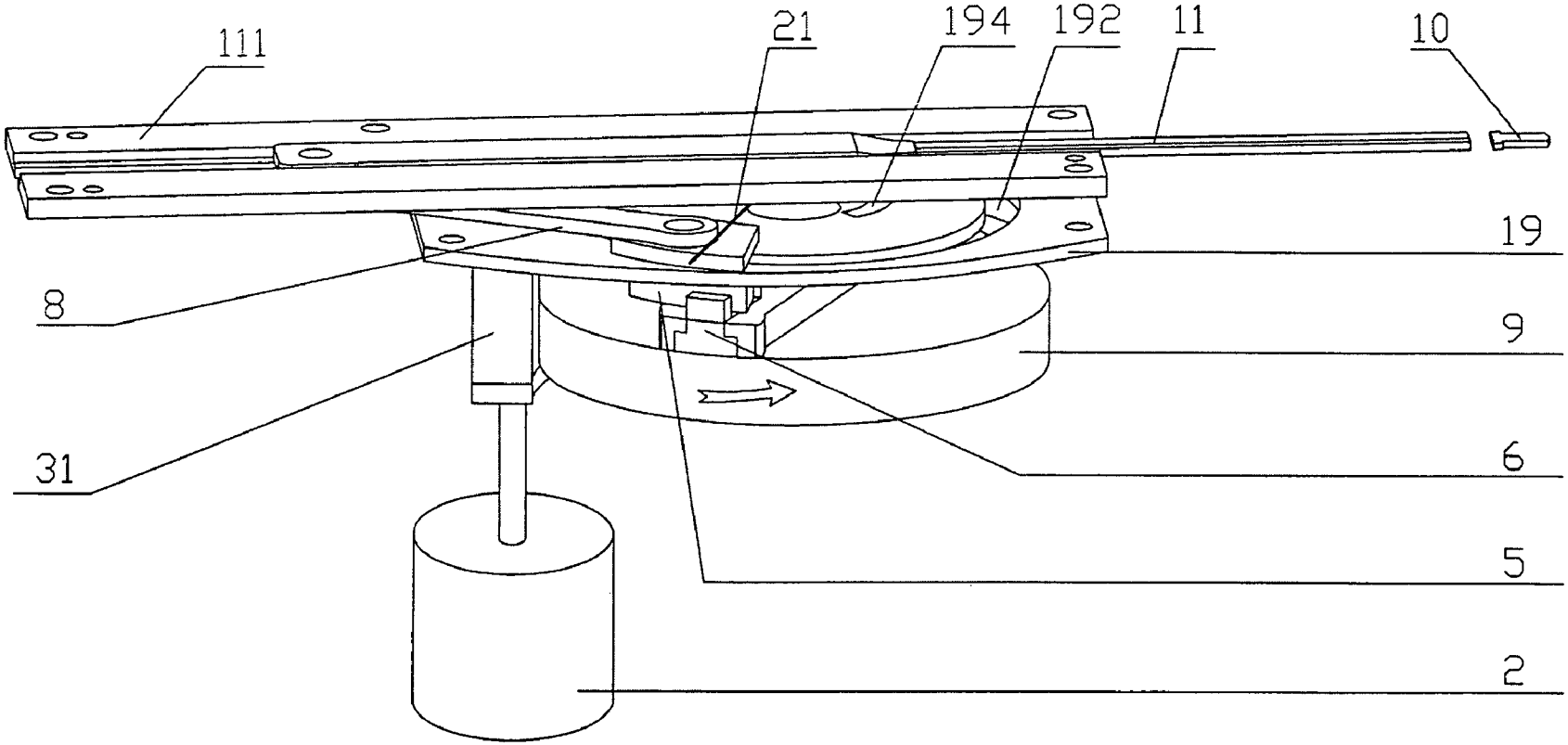
FIG. 5 is the moving state of the clutch bar (in clutch mechanism) and driving block before coupling.
Figure 6:
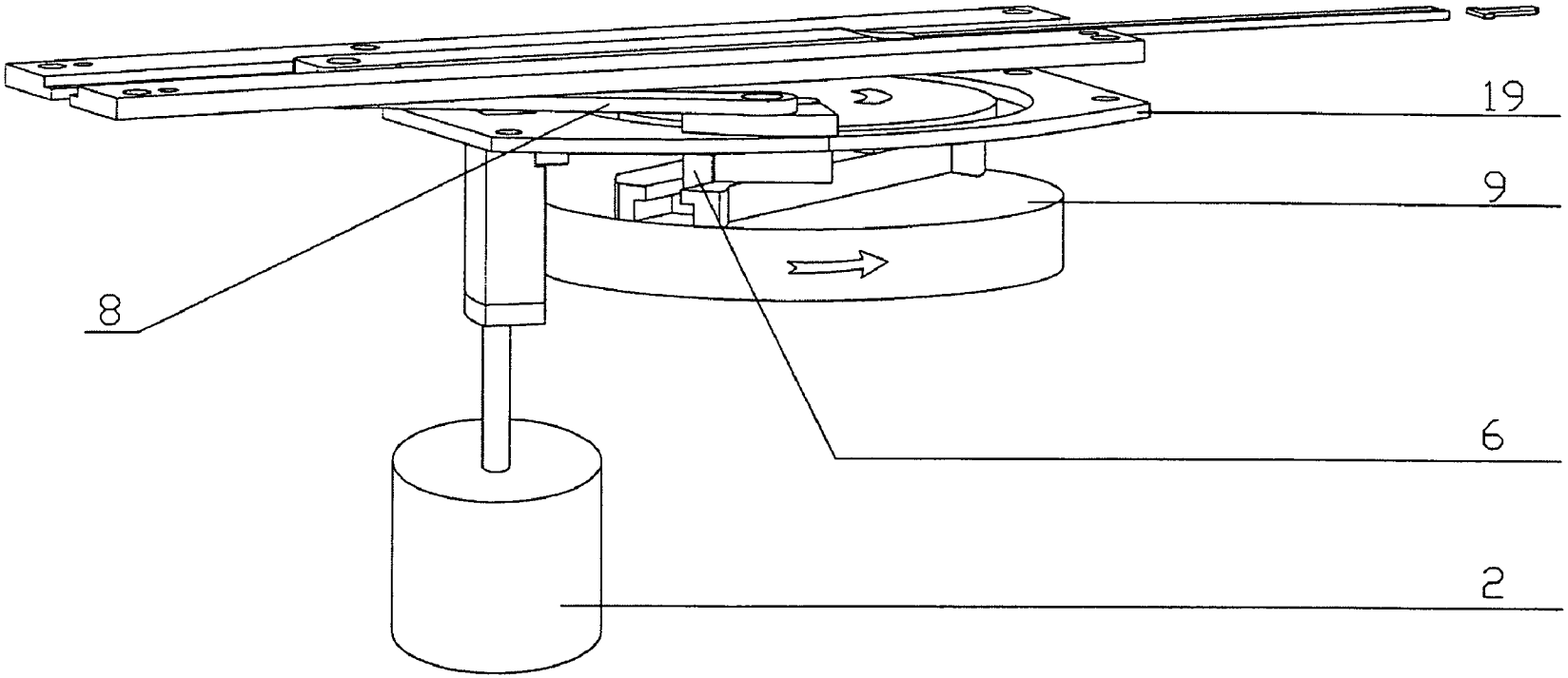
FIG. 6 is the moving state of the clutch bar (in clutch mechanism) coupling to driving block.

Referring to FIG. 1, FIG. 2, FIG. 4, one preferred embodiment of the invention comprises: a motor (1); means for obtaining electric power from a power source or rechargeable battery; solenoid (2), cam (3), clutch spring (4), driving block (5) clutch bar (6), disengage block (7), pitman (8), flywheel (9), fastener (i.e. Nail, Staple) (10), drive unit (11), tension spring (12), pinion (13), trigger (14), main switch (15), safety switch (16), power source (17), control unit (18), slot board (19), bracket (20), twisting spring (21), twisting spring cover (22), bearing (23), magazine and nail feeding device (201). The power source (17) and the control unit (18) are connected to a main switch (15) and a safety switch (16) in series, trigger (14) is directly controlled by the main switch (15). Motor (1) is coupled to an impact mechanism by a speed reducing mechanism; the drive unit (11) of the driving mechanism is connected to a pitman (8) by a pin axis (112) on one end, the other end of the pitman is connected with the driving block (5) by pin axis (85), where the driving block does an arc movement during the driving process. The clutching mechanism of the speed reduction mechanism controls the circular motion of the driving block (5) to produce linear movement in the drive unit (11).

Figure 11:
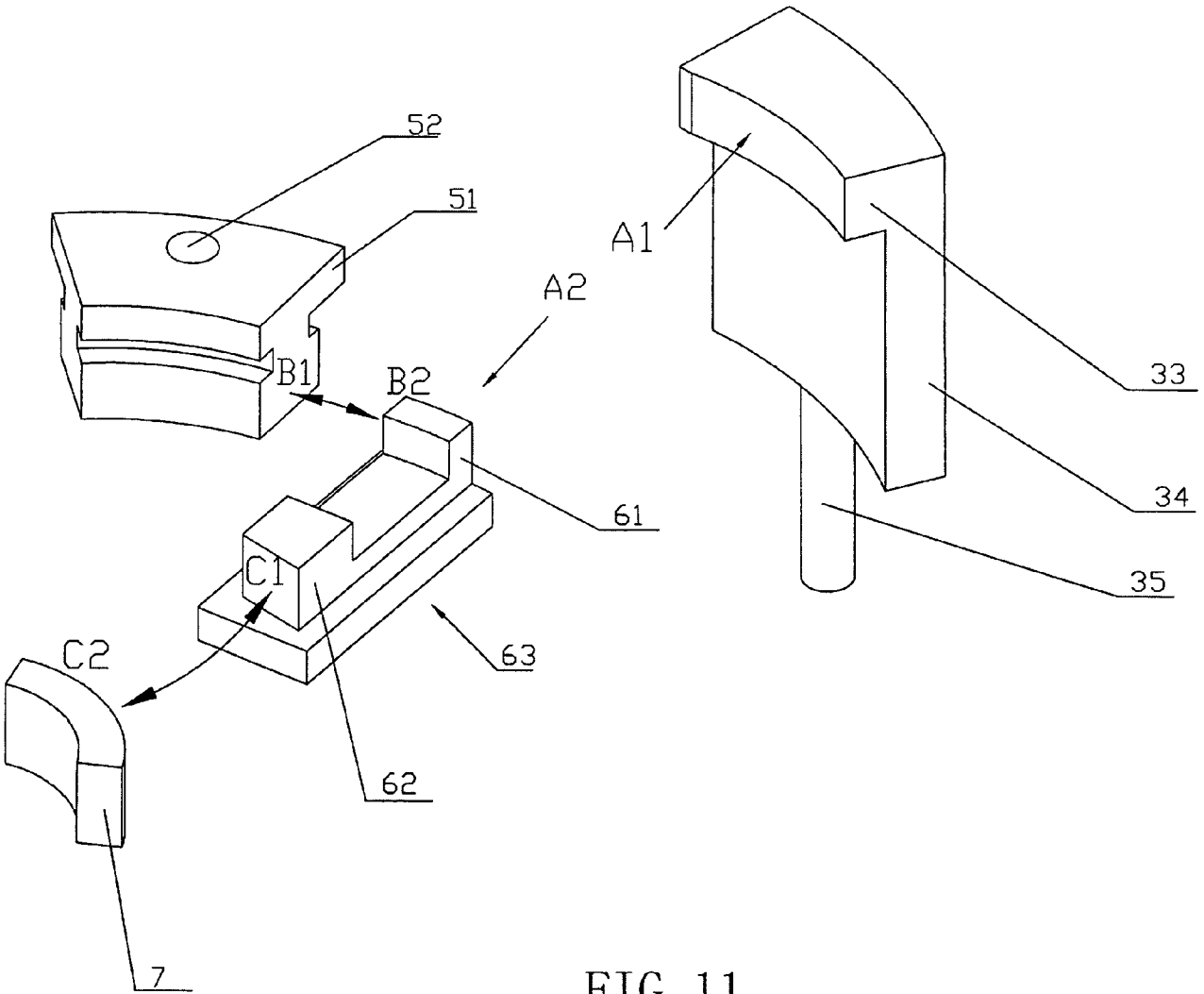
FIG. 11 is the schematic drawing of the relationship between cam, driving block, clutch bar and disengage block.

Referring to FIG. 11, in one embodiment, the clutch mechanism comprises: solenoid (2), cam (3), and clutch spring (4) and driving block (5), clutch bar (6), disengage block (7), which has a bulge (33), wall (34), support rod (35) in the coping; the armature (211) of the solenoid (2) is fastened to the support rod (35), which is at the bottom of cam (3), the slot (31) and base plate (32) are fastened to the bracket (20), which allows the cam (3) to slide up and down relative to the slot (31). The clutch bar (6) has an outer bulge (61) and inner bulge (62), the space between them providing a gate (63) allowing the driving block (5) to pass through, the clutch bar (6) presses the clutch spring (4) and is loaded in a radial slide slot (91) of the flywheel; the two endpoints of fixed axis (191) are fastened to the slot board (19) and bracket (20) respectively, and flywheel (9) is positioned between them; the slot board (19) has a camber slide slot (192) and holes (194), the holes are used for mounting the disengage block (7). Referring to item "193" in the FIG. 4, it is the initial installing window that introduces the driving block into the camber slide slot. In the condition of compressing the clutch spring (4), the distance between the inner bulge (62) of the clutch bar (6) and the fixed axis (191) corresponds to the distance between the disengage block (7) and the fixed axis (191), and allows the clutch bar (6) to be pushed by the disengage block (7) when turned to the angular position of the disengage block (7).

The cross-section of the driving block (5) has an "I" shape. The upperside (52) of the driving block has a fixed pin axis (85), the underside (51) is coupled to the outer bulge of the driving block (5), the middle part is settled in the arcuate slot (192) of the slot board (19), and holds the driving block (5) fixed in the slot board and allows it to slide relatively.

The driving mechanism comprises: the drive unit (11) of the driving mechanism connected to a pitman (8) by a pin axis (85) on one end, and connected on the other end to the pin axis (85) of the driving block (5) which does an arcuate movement. One end of the drive unit (11) is connected with the tension spring (12) and long board (111) to the long slot in which they have a sliding movement. The clutching mechanism of the speed reduction mechanism controls the circular motion of the driving block (5) to produce linear movement in the drive unit (11).

Figure 3:
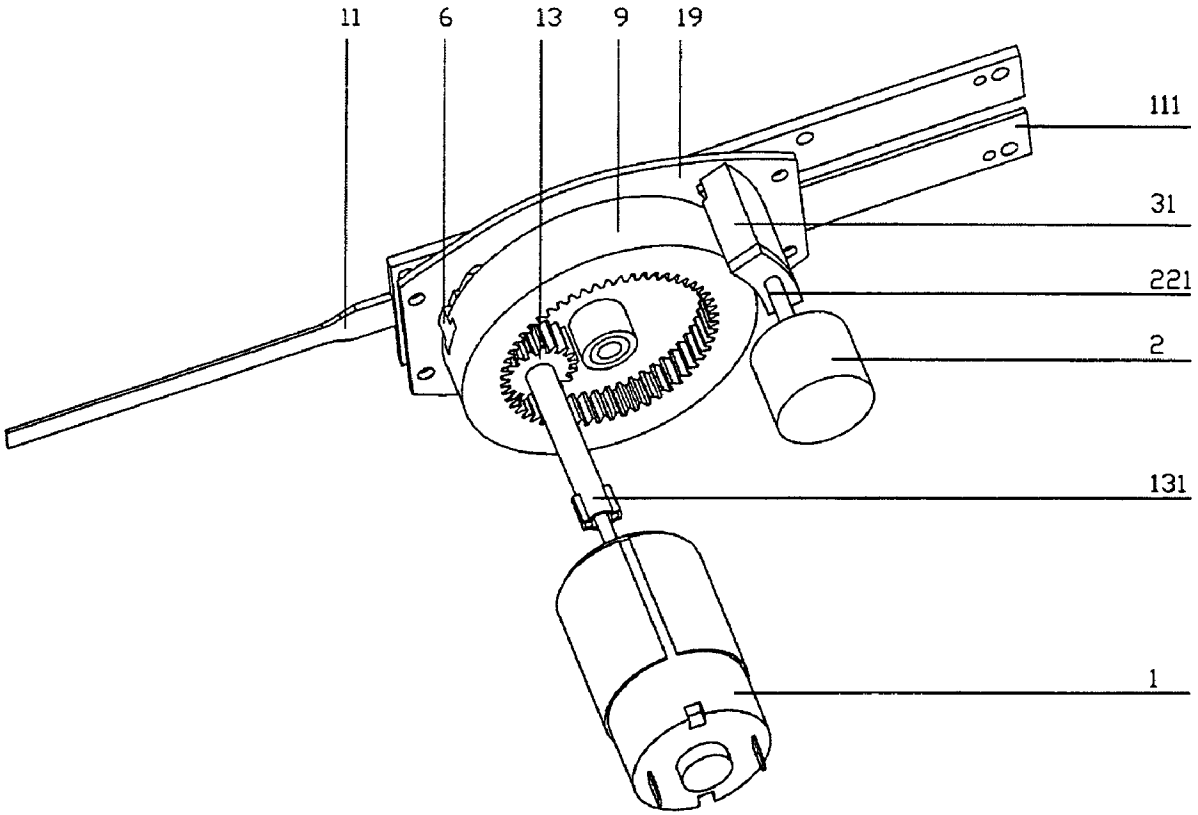
FIG. 3 is the schematic drawing of the speed reducing mechanism.

Referring to FIG. 3, the slot board (19) is fastened on a bracket (20). The speed reduction mechanism includes a pinion (13) and flywheel (9) which engage each other, the pinion (13) is driven by the motor against a circular rack formed, in one embodiment, on an interior peripheral surface of the flywheel (9), and the flywheel (9) is rotated around a fixed axis (191).

Referring to FIG. 5-11, in one embodiment the gun works as follows: It uses a motor with an electrical source of chargeable battery output power source for driving. When the safety switch (16) is squeezed, the main switch (15), and control unit (18) start working, an electric circuit connects a motor (1) via pinion (13) driving the flywheel (9) rotating at a high speed. When the flywheel (9) is rotating at an enactment speed and the trigger is depressed, the control unit (18) will send an actuation signal to the solenoid (2), the solenoid retracts and the driving cam (3) moves down, allowing the elastic force of the clutch spring (4) to exert pressure on the face of inner bulge (62) of the clutch bar and push it towards the center of a circle of the flywheel along a radial runner (193). As the clutch bar (6) moves inward, the outer bulge (61) comes into space of the arcuate slot (192), the face B2 of the clutch bar (6) contacts the face B1 of the driving block (5). The rotational flywheel (9) pushes the driving block (5), by the clutch bar (6) to travel around the arcuate slot (192) pulling the axially connected pitman (8). When the driving block (5) moves to its far point in the arcuate slot (192) the drive unit (11) also moves to its far point driving the fastener (10), and the tension spring (12) and torsion spring (24) save energy to a maximum. When the clutch bar (6) and the face C1 of inner bulge is pushed back to original position by the face C2 of the disengage block (7), the gate (63) moves back to a position beneath of the arcuate slide slot (192), and the driving block (5) loses impulse from the flywheel (9) and after having liberated momentary energy, it is returned to its starting point. Thus the energy from the flywheel (9) is released into the drive unit (11), pushing nails into the substrate. When the nail driving has been completed, the driving block (5) and the drive unit (11) are returned to their starting positions by the twisting spring (21) and the tension spring (12) respectively, and the circuit is ready for another cycle.

Figure 7:
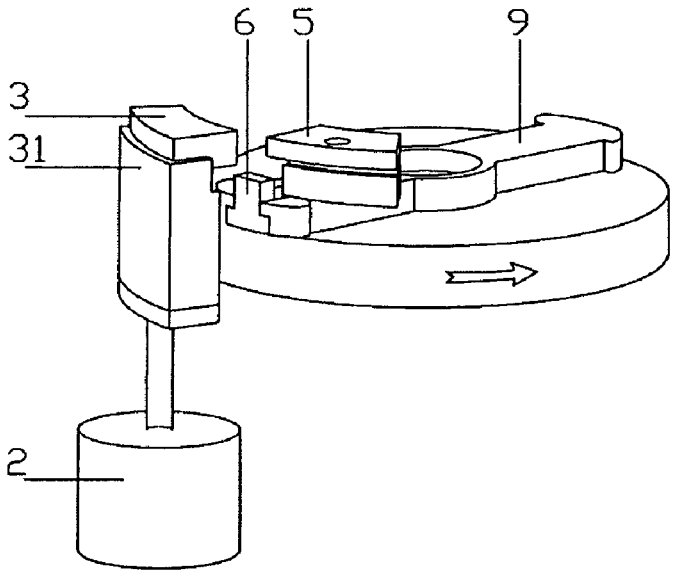
FIG. 7 is the moving state of unmarked components on slot board which reference FIG. 5.
Figure 8:
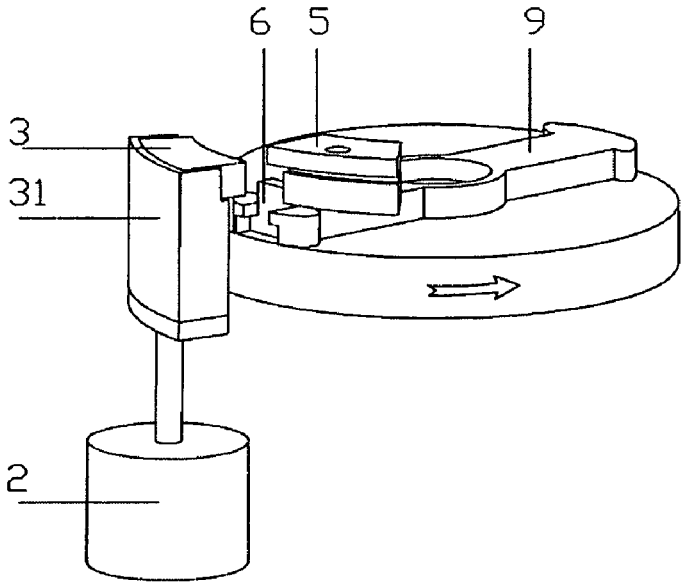
FIG. 8 is the moving state of unmarked components on slot board which reference FIG. 6.
Figure 9:
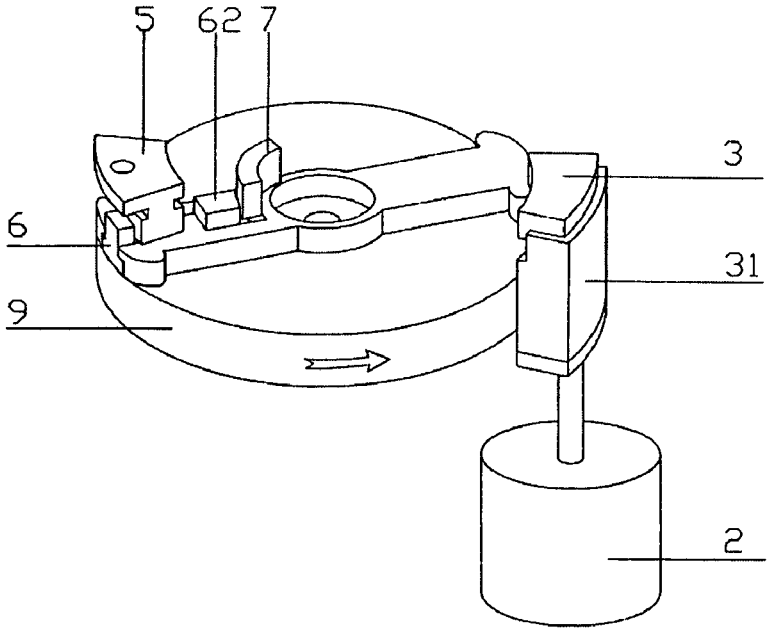
FIG. 9 is the moving state to opposite direction of FIG. 7
Figure 10:
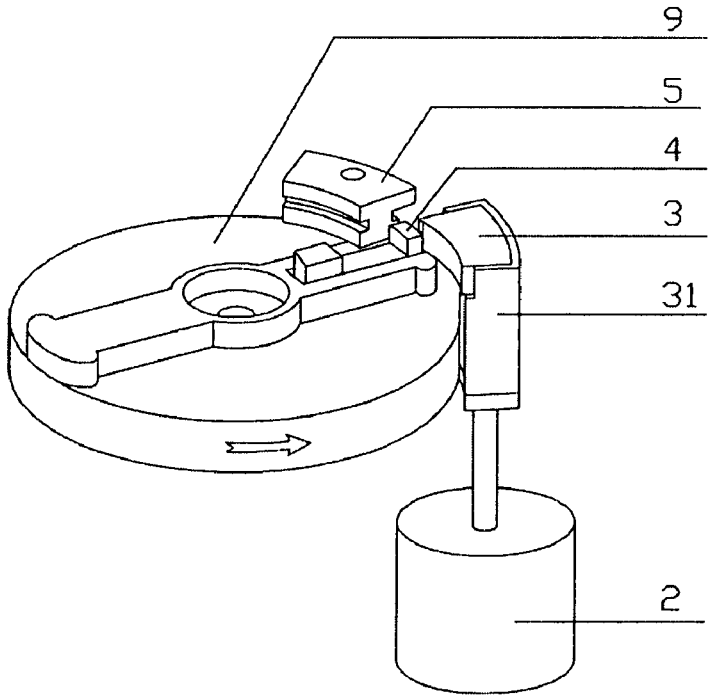
FIG. 10 is the moving state to opposite direction of FIG. 7

Referring to FIG. 7, when the flywheel rotates in high speed but no signal is sent to solenoid (2), the clutch bar (6) departs from the driving block (5), and the flywheel will idle. Referring to FIG. 8, and FIG. 10, in one embodiment, when the cam (3) moves down, the face A1 of the cam bulge exerts pressure on the face A2 of the clutch bar (6) overcoming the elastic force of the clutch spring (4) and pushes the clutch bar (6) towards the center of the flywheel (9) and along a radial runner (193). The clutch bar (6) engages the driving block (5) and after departing from the cam (3), strong rotary inertia forces makes it keep pushing the driving block (5). Referring to FIG. 9, when the flywheel rotates in a high speed and the clutch bar (6) engages the driving block (5) and after turning it to the far position on the arc slot (192), the clutch bar (6) and the face C1 of inner bulge (62) is squeezed against the disengage block (7), causing the clutch bar (6) to move outward on the flywheel (9).

Referring to FIG. 7, 8, 9, 10, 11, when the clutch bar (6) engages the driving block (5), and the high speed rotating flywheel (9) departs from cam (3), let us suppose that the trigger button releases suddenly or the tool breaks down suddenly when in use, the flywheel (9) stops rotating, the clutch bar (6) loses the strong rotary inertia, and the inertial force returns to zero. The clutch bar (6) moves in the direction of the outer circle of flywheel, urged by the clutch spring (4), at the same time allowing the system to return to the starting point.

To be brief, once the flywheel (9) stops high speed rotation, the system can return to the initial state, without needing any memory of the rotating state.

The herein described embodiments are exemplary only and are not intended to limit the scope of the invention.

We claim:

1. An electrical motor driven nail gun comprising:

an electric drive motor electrically connected to a power source, a fastener feeding device with a magazine for feeding fasteners, and a trigger connected to a control unit for activating a fastener driving action;

a rotational motion speed reduction drive assembly further comprising a pinion gear fixed to an output shaft of the motor, and a flywheel with a rack gear formed on an inward facing peripheral surface and engaging the pinion gear;

a linear motion conversion linkage, further comprising a slot board having an arcuate slot with an axis in a central portion, a driving block slidingly mounted in said arcuate slot, a pitman with a proximal end portion pivotably connected to the driving block, and an elongate drive unit having a first end portion and an opposite second end portion with the first end portion pivotably connected to a distal end portion of the pitman;

a clutching mechanism mounted to the flywheel, having a clutch bar engaging the driving block when the trigger is activated to drive a fastener, and a disengage block for disengaging the clutch bar from the driving block on completion of the driving action; and a long board having a first end portion and an opposite second end portion, with a longitudinal long slot in which the drive unit is disposed with linear sliding motion, and with an elastic member connecting the first end portion of the drive unit to the first end portion of the long board;

wherein fasteners are delivered by the feeding device to the second end portion of the long board where the fasteners are driven one-by-one by the second end portion of the drive unit, the rotating energy of the flywheel being converted by the linkage mechanism to lateral movement of the drive unit for driving the fasteners.

2. The electrical motor driven nail gun according to claim 1, in which the flywheel rotates on a axis in a space formed between the slot board and a bracket.

3. The electrical motor driven nail gun according to claim 1, in which the clutching mechanism further comprises a solenoid connected to the control unit, a cam driven by the solenoid, the clutch bar being mounted in a slot on the flywheel and urged outward from the axis of the flywheel by a clutch spring;

wherein when the solenoid moves the cam into position for driving a fastener, the cam moves the clutch bar against the clutch spring, the clutch bar advances the driving block causing a fastener to be driven, and when the clutch bar strikes the disengage block mounted on the slot board the clutch bar is disengaged allowing the driving block to return to a starting position.

4. The electrical motor driven nail gun according to claim 3, wherein the driving block has an I-shaped cross-section, an upper side portion of the driving block has an axis pin connected to the pitman, a middle portion is slidingly disposed in the arcuate slot of the slot board, and the underside portion is engageable with the outer bulge of clutch bar;

wherein in the course of the flywheel rotating, the disengage block contacts the inner bulge of the disengage block causing the clutch bar to disengage, allowing the disengaged drive block to return to its original position urged by a return spring, thereby completing a fastener driving cycle.

5. The apparatus according to claim 3, wherein the clutch spring has a strength which is pre-selected to offset the inertial force on the clutch bar from the high speed rotating flywheel such that when the clutch bar leaves the cam, it will not be pushed outward and will be able to keep pushing the driving block to complete a fastener driving operation.

6. The electrical motor driven nail gun according to claim 3, wherein the power source of the motor or, in the alternative rechargeable batteries, are connected to a main switch and a safety switch in series between the control unit and the motor, with the safety switch connected to the control unit.

7. The electrical motor driven nail gun according to claim 1, wherein the clutch bar has an outer bulge and an inner bulge, the space between them forming a gate, the gate shifts when the clutch bar is pushed by the cam, causing the outer bulge to engage the driving block, causing the driving block and the pitman to travel along the arcuate slot urged by the by clutch bar which is driven by the high speed rotating flywheel.

8. The electrical motor driven nail gun according to the claim 1, wherein the elastic member connecting the first end portion of the drive unit to the first end portion of the long board is a spring.

* * * * *